US005841404A

United States Patent [19]

Yen

[11] Patent Number: 5,841,404

[45] Date of Patent: Nov. 24, 1998

[54] ELECTROMAGNETIC WAVE TRANSMITTING AND TRANSFERRING DEVICE WITH HIGH POLARIZATION ISOLATION PERFORMANCE

[76] Inventor: Kerl Yen, No. 3, Tzu Chiang I Rd., Chung Li City, Tao Yuan Hsien, Taiwan

[21] Appl. No.: 796,062

[22] Filed: Feb. 4, 1997

[51] Int. Cl.[6] ..... H01Q 13/00

[52] U.S. Cl. ..... 343/786; 333/21 A; 343/756

[58] Field of Search ..... 333/21 R, 21 A; 343/756, 786

[56] References Cited

U.S. PATENT DOCUMENTS 4,737,741 4/1988 Wong ..... 333/21 A

FOREIGN PATENT DOCUMENTS 5-83004 4/1993 Japan ..... 333/21 A 6-232602 8/1994 Japan ..... 333/21 A

*Primary Examiner*—Paul Gensler

*Attorney, Agent, or Firm*—Rosenberg, Klein & Bilker

[57] ABSTRACT

An electromagnetic wave transmitting and transferring device with high polarization isolation performance is provided which comprises a circular waveguide and a rectangular waveguide. The circular waveguide has a hollow configuration which has an opening at a front end portion and a closed surface at the rear end. The opening of the circular waveguide is provided with a horn. The circular waveguide is provided with a polarizer, a first probe, a metallic post and a closed end surface serving as a conductive back surface, wherein the first probe is perpendicular to the metallic post and each of them are inclined with respect to the polarizer by 45 degrees. The rectangular waveguide is perpendicular to the circular waveguide and the central axis of the rectangular waveguide is in alignment with the first probe. The rectangular waveguide is provided with a second probe and a conductive back surface serving as closed end surface. The second probe is disposed on a central axis of the wide side of the rectangular waveguide to collect the reflected signal which is polarized and parallel to the metal post.

3 Claims, 7 Drawing Sheets

ELECTROMAGNETIC WAVE TRANSMITTING AND TRANSFERRING DEVICE WITH HIGH POLARIZATION ISOLATION PERFORMANCE

FIELD OF THE INVENTION

The present invention relates to an electromagnetic wave transmitting and transferring device with high polarization isolation performance. When it is applied to the receiving down converter of a satellite receiving system, the printed circuit board and the incident wave can be disposed in perpendicular relationship, i.e. the low noise amplifier can be L-shaped. Since the shape and dimension can be suitably arranged and combined, as it is applied to the frequency frequently used, a high polarization isolation performance and a good voltage standing wave ratio (approximate to 1:1, but not larger than 2:1) are attained.

PRIOR ART

In recent years, since satellite TV services, such as Direct TV, have become more and more popular, the L-shaped down converter has also had a rapid growth in the marketplace. Of existing down converters, a portion of them have a merely acceptable polarization isolation. To those down converters which have better polarization isolation, such is attained by an additional reflector to make the probes have a greater distance therebetween. By this arrangement an incident wave which introduces the signal can be perpendicularly disposed with respect to the printed circuit board thereof.

SUMMARY OF THE INVENTION

It is the objective of this invention to provide an improved transmitting and transferring device which has excellent polarization isolation performance wherein a simple reflector (metallic post) is applied to facilitate the transmitting and transferring.

It is still the objective of this invention to provide an electromagnetic wave transmitting and transferring device with high polarization isolation performance, wherein the circular waveguide has a polarizer, a probe, a metallic post, and a closed end surface that serves as a conductive back surface. The probe is perpendicular to the metallic post and is offset with respect to the polarizer by 45 degrees. The central axis of the rectangular waveguide which is perpendicular to the circular waveguide is in alignment with the probe of the circular waveguide. The rectangular waveguide is provided with a probe which serves a closed end surface of the conductive back surface. The probe is disposed on the central axis of the rectangular waveguide to receive the reflected polarized signal which is parallel to the metallic post, i.e. which is located in the same plane to the probe of the circular waveguide. Accordingly, high polarization isolation and excellent input standing wave ratio performance are achieved.

BRIEF DESCRIPTION OF THE DRAWINGS

In order that the present invention may more readily be understood the following description is given, merely by way of example, with reference to the accompanying drawings, in which.

BRIEF DESCRIPTION OF NUMERALS

Figure 1:
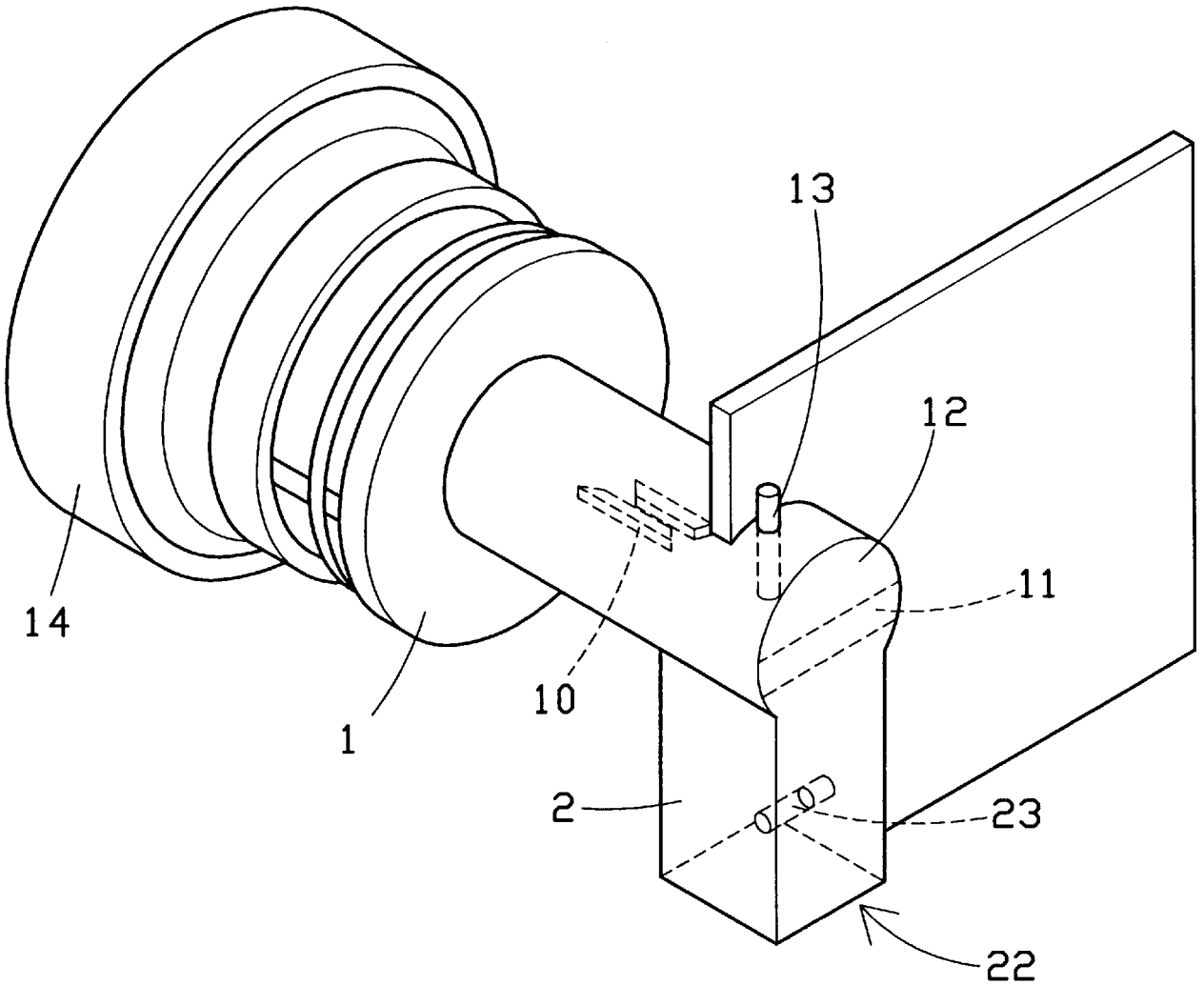
FIG. 1 is a perspective view of the transmitting and transferring device made according to this invention wherein when it is used on linear polarization, no polarizer is applied.

1 circular waveguide
10 polarizer
11 metallic post
12 conductive back surface
13 first probe
14 horn
2 rectangular waveguide
22 conductive back surface
23 second probe

DETAILED DESCRIPTION OF PREFERRED EMBODIMENT

Figure 2:
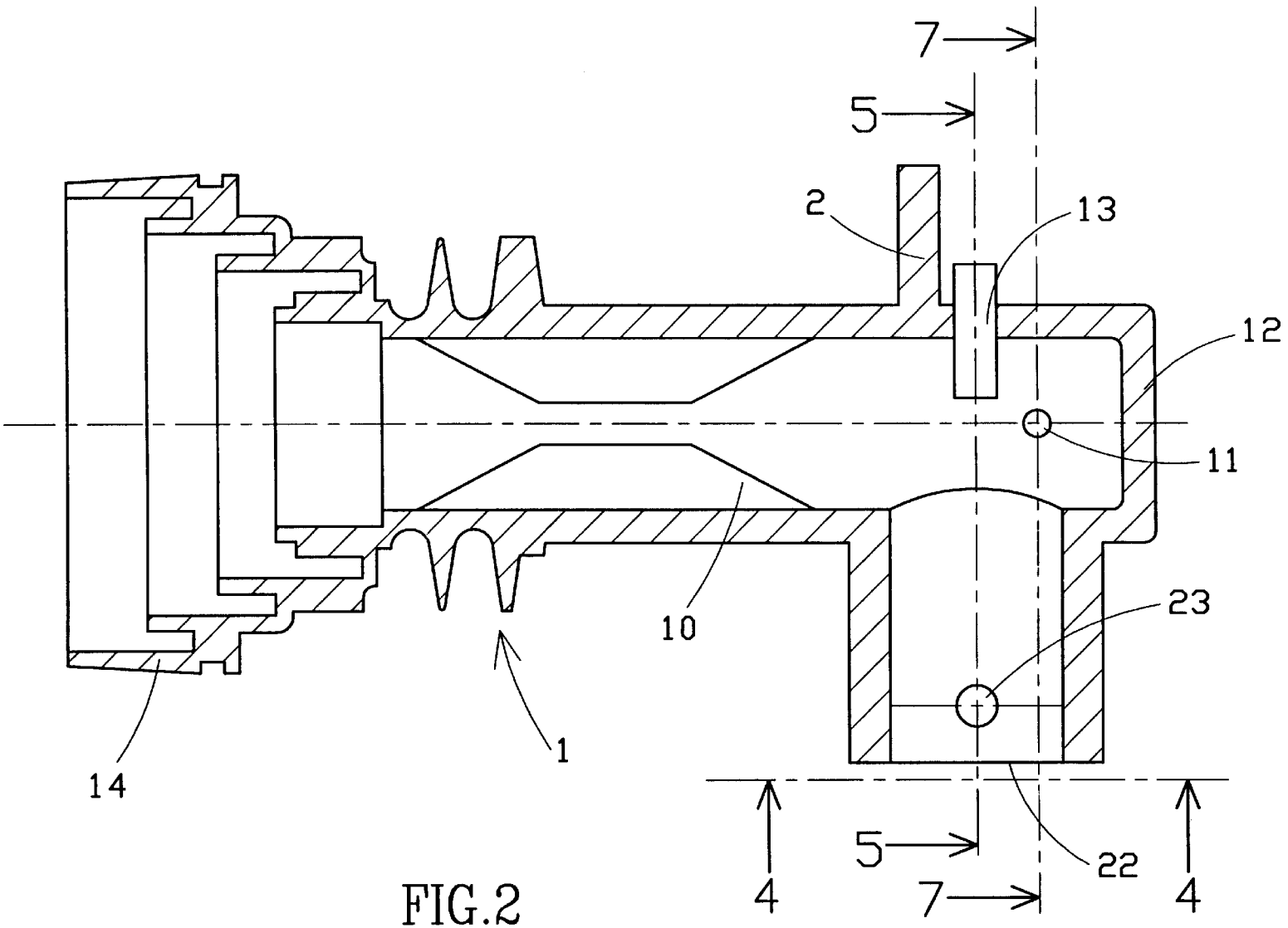
FIG. 2 is a cross-sectional view of the transmitting and transferring device made according to this invention wherein when it is used on linear polarization, no polarizer is applied.
Figure 3:
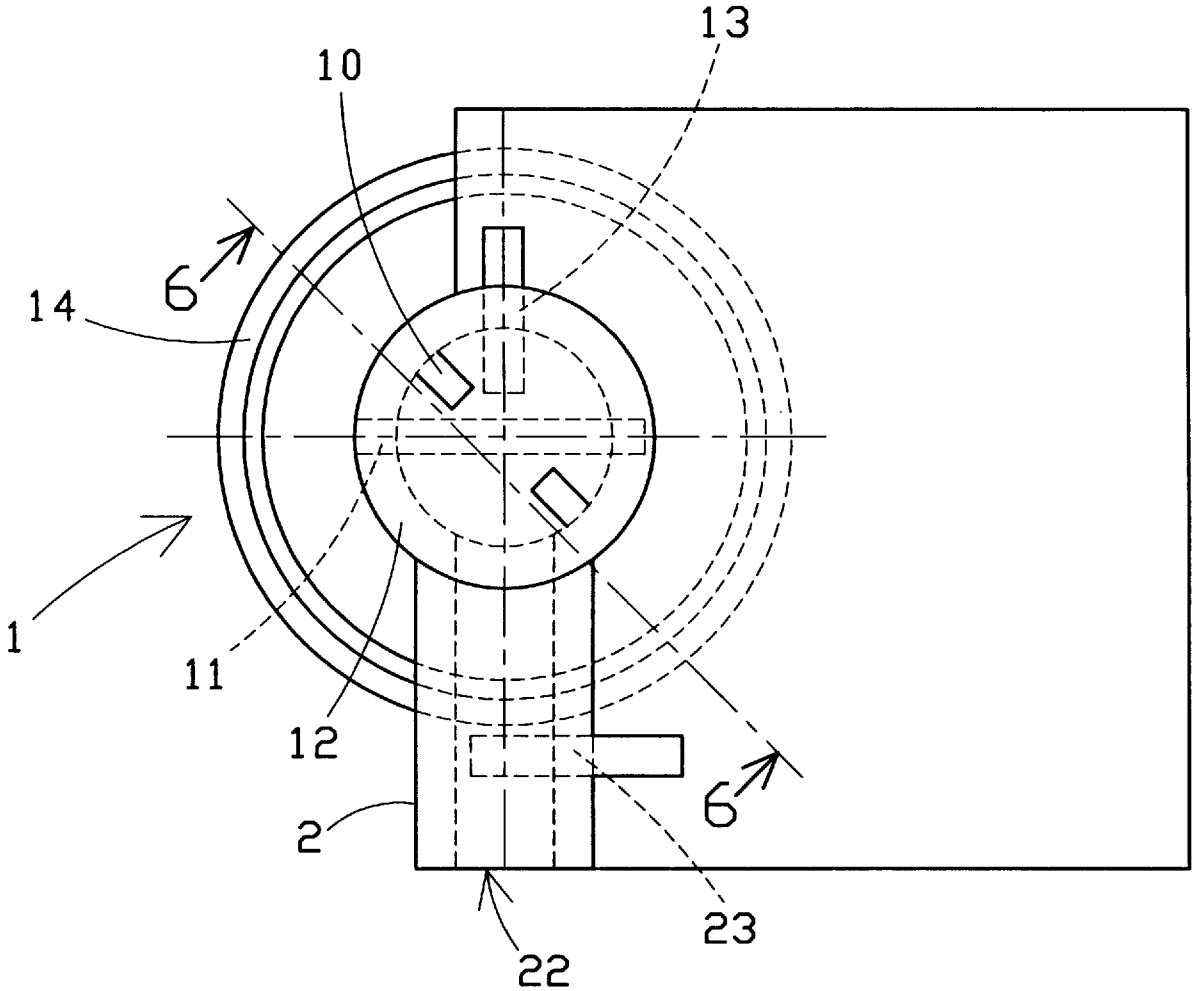
FIG. 3 is a front end elevation view of the transmitting and transferring device made according to this invention wherein when is used on linear polarization, no polarizer is applied.
Figure 4:
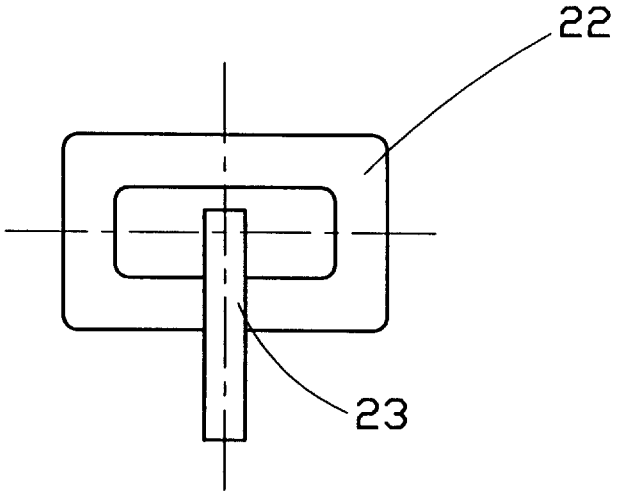
FIG. 4 is a cross-sectional view taken from line 4—4 of FIG. 2.
Figure 5:
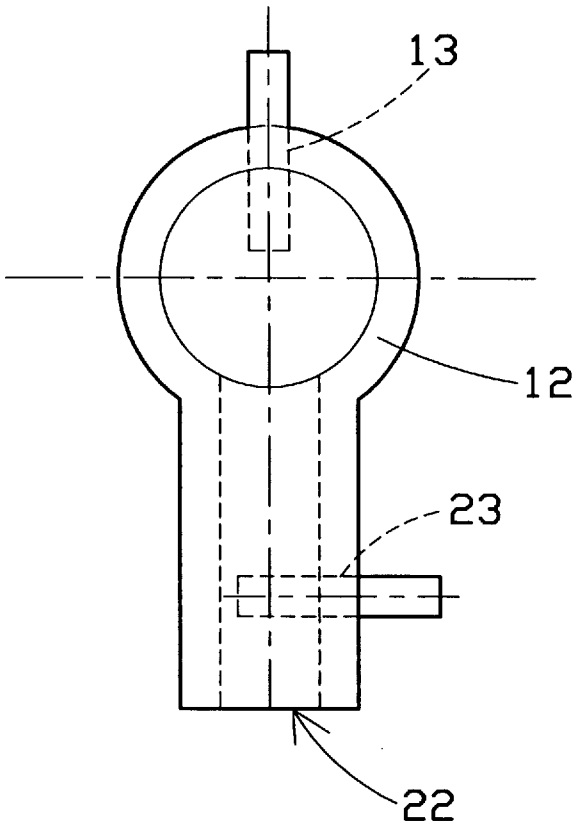
FIG. 5 is a cross-sectional view taken from line 5—5 of FIG. 2.
Figure 6A:
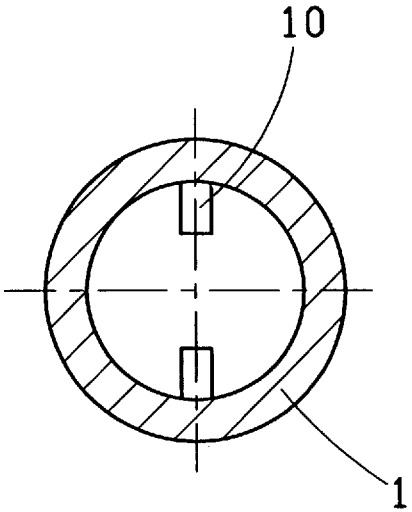
FIG. 6A is a cross-sectional end view of the polarizer of FIG. 6.
Figure 6:
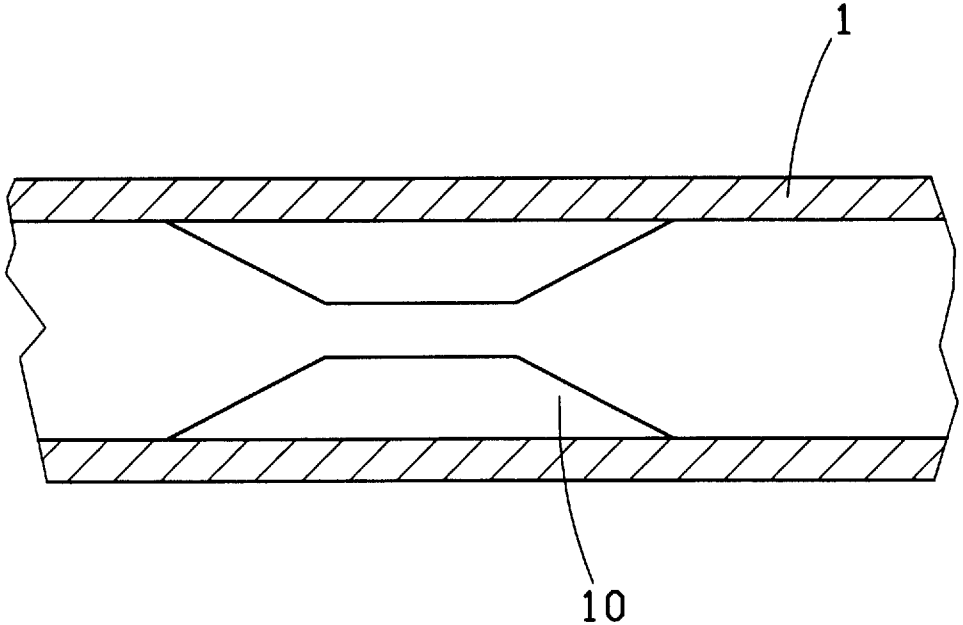
FIG. 6 is a cross-sectional view of a polarizer taken from line 6—6 of FIG. 3.
Figure 7:
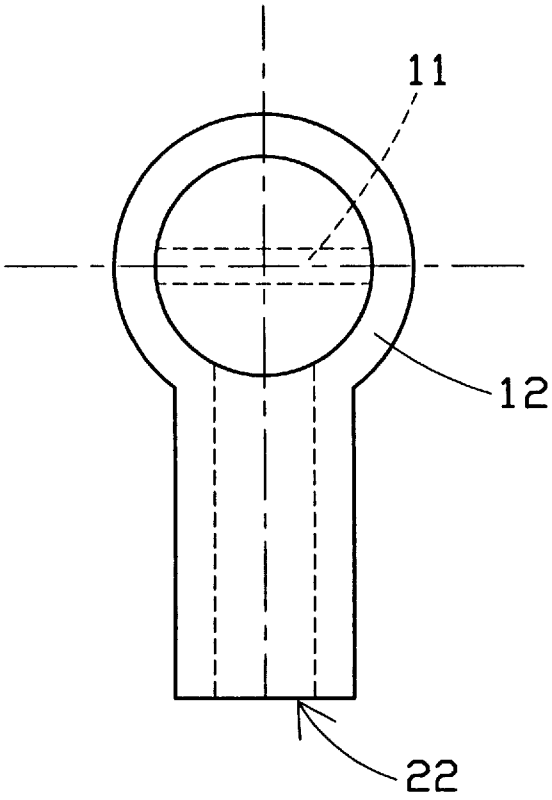
FIG. 7 is a cross-sectional view taken from line 7—7 of FIG. 2.

Referring to FIGS. 1 to 7, the electromagnetic wave transmitting and transferring device with high polarization performance generally comprises a circular waveguide 1, a rectangular waveguide 2, a first probe 13, a second probe 23 and a reflector or metallic post 11.

The circular waveguide 1 has a hollow configuration having an opening at the front end portion and a closed surface at the rear end. The opening of the waveguide 1 is disposed with a horn 14. The horn 14 projects outwardly and has multiple windings to reduce noise from the rear portion of the waveguide 1. Within the waveguide 1, a polarizer 10, a first probe 13, a metallic post 11 and a closed end surface which serves as conductive back surface 12 are disposed therein. The first probe 13 is perpendicular to the metallic post 11 and each of them are inclined with respect to the polarizer 10 by 45 degrees. Because of the design of the dimensional shape of the polarizer 10, the signals between the electric field which is parallel to the section line 6—6 of FIG. 3, and the signal which is perpendicular to the line 6—6 of FIG. 3, have a phase differential of 90 degrees after the signals pass through the polarizer 10. Accordingly, when the incident wave is circular polarized wave, a linear polarized wave which is parallel to the first probe 13 or the metallic probe 11 will be obtained when it passes through the polarizer 10.

The conductive back surface 12 is disposed in the rear side of the first probe 13 at a location about $\lambda^{(a)}{}_g/4$ apart from the probe 13. By this arrangement, the input standing wave ratio of the first probe 13 is approximate 1:1. The $\lambda^{(c)}{}_g$ is an equivalent wavelength of the circular waveguide 1. In the area adjacent to the rectangular waveguide 2, the $\lambda^{(c)}{}_g$ can not be calculated by the simple formula for a circular waveguide 1.

$$\lambda^{(c)}{}_g = \sqrt{{}_{1-}\lambda^2/\lambda^2{}_{cc}} \tag{1}$$

Wherein $\lambda$ cc=3.412 r which is the cutoff wavelength of the circular waveguide 1 and r is radius of the circular waveguide, $\lambda$ is wavelength in free space. Because the rectangular waveguide 2 is provided with an opening, there is an equivalent radius $r_{eff}$ which is longer than the substantial radius r in the adjacent area. In order to get an accurate calculation, the r is replaced by the $r_{eff}$, accordingly, the resulting r value is shorter than the substantial $\lambda^{(c)}{}_g$. In light of this, the location of the back surface of the first probe 13 is designed accordingly.

The metallic post 11 is disposed at the rear side of the first probe 13 (apart therefrom by about 5 millimeters), in order to effectively reflect the signal, which has been polarized and is parallel to the metallic post 11, to the rectangular waveguide 2 and received by the second probe 23 disposed therein. Similarly, in order to increase the performance, the distance between the metallic post 11 and the conductive back surface 12 is not greater than $\lambda^{(c)}{}_g/4$. In the present invention, the distance between the metallic post 11 and the conductive back surface 12 and between the first probe 13 and the conductive back surface 12 is not greater than $\lambda^{(c)}{}_g/4$ to suitably position the conductive back surface 12. Since the value of $\lambda^{(c)}{}_g$ is also proportional to the cross-section of the rectangular waveguide 2, the above described consideration will influence the cross-sectional dimension of the rectangular waveguide 2.

The rectangular waveguide 2 is perpendicular to the circular waveguide and the central axis of the rectangular waveguide 2 is in aligned relationship with the first probe 13 disposed within the circular waveguide 1. The rectangular waveguide 2 is provided with a second probe 23 and a conductive back surface 22 that serves as a closed end surface. The second probe 23 is disposed on a central axis of the wide side of the rectangular waveguide 2 to collect and receive a polarized signal which is also parallel to the metal post 11, wherein this polarized signal is also perpendicular to the first probe 13.

In order to enhance the collecting rate of the second probe 23, the conductive back surface 22 is disposed in a location spaced from the second probe 23 by about $\lambda^{(r)}{}_g/4$. By this arrangement, the input standing wave ratio is about 1:1. The distance between the second probe 23 and the closed end surface in the required frequency band is about $\lambda^{(r)}{}_g/4$, wherein $\lambda^{(r)}{}_g$ is the wavelength of the rectangular waveguide 2 and which can be calculated from the following formula:

$$\lambda^{(r)}{}_g = \lambda/\sqrt{1-\lambda^2/\lambda^2_{cr}}$$

wherein $\lambda_{cf}$=2 a is the cutoff wavelength and a is the cross-section of the wide side of the rectangular waveguide 2. Further, the length of the first probe 13 approximates $\lambda^{(r)}{}_g/4$.

From the above description, it can be readily appreciated that by the provision of the electromagnetic wave transmitting and transferring device with high polarization isolation performance made according to the present invention, the high polarization isolation and voltage standing wave ratio of 11 can be readily attained.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. An electromagnetic wave transmitting and transferring device with high polarization isolation performance, comprising:

a circular waveguide having a hollow configuration with an opening at a front end portion and a closed surface at a rear end thereof, said opening of said circular waveguide having an outwardly projecting horn, said horn being formed with multiple windings, said circular waveguide having a polarizer, a first probe, a metallic post and said closed end surface serving as a conductive back surface disposed therein, said first probe being perpendicular to said metallic post and both said first probe and metallic post being inclined with respect to said polarizer by 45 degrees;

a rectangular waveguide disposed perpendicular to said circular waveguide and the central axis of said rectangular waveguide being in aligned relationship with said first probe disposed within said circular waveguide, said rectangular waveguide having a second probe and a conductive back surface serving as a closed end surface, said second probe being disposed on a central axis of a wide side of said rectangular waveguide to collect and receive a reflected signal which has been polarized and is parallel to said metal post and coplanar to said first probe of said circular waveguide.

2. The electromagnetic wave transmitting and transferring device as recited in claim 1, wherein a distance between said first probe, said metallic post and said closed end surface within said circular waveguide is not greater than $\lambda^{(c)}{}_g$, wherein $\lambda^{(c)}{}_g$ is an equivalent wavelength of said circular waveguide, the length of said first probe being approximately $\lambda^{(r)}{}_g$ where $\lambda^{(r)}{}_g$ is the wavelength of said rectangular waveguide.

3. The electromagnetic wave transmitting and transferring device as recited in claim 1, wherein the distance between said second probe and said closed end surface of said rectangular waveguide is approximately $\lambda^{(r)}{}_g/4$ of a required frequency band, wherein $$\lambda^{(r)}_g = \lambda/\sqrt{1-\lambda^2/\lambda^2_{cr}}$$

is a wavelength of said rectangular waveguide, $\lambda cr$ =2 a is a cutoff wavelength and a is a length of said wide side of a cross-section of said rectangular waveguide.

* * * * *